United States Patent [19]

Orbeck

[11] Patent Number: 4,586,898

[45] Date of Patent: May 6, 1986

[54] MULTI-ZONE FURNACE SYSTEM

[75] Inventor: Gary A. Orbeck, Windham, N.H.

[73] Assignee: BTU Engineering Corporation, North Billerica, Mass.

[21] Appl. No.: 681,952

[22] Filed: Dec. 14, 1984

[51] Int. Cl.[4] ..... F27B 9/14; F27B 9/02; F27D 3/00

[52] U.S. Cl. ..... 432/122; 432/128; 432/239

[58] Field of Search ..... 432/11, 122, 128, 239

[56] References Cited

U.S. PATENT DOCUMENTS 3,304,210 2/1967 Lofstrom ..... 432/122
3,373,980 3/1968 Borgkvist ..... 432/11
4,397,451 8/1983 Kinoshita ..... 432/128

FOREIGN PATENT DOCUMENTS 2904938 2/1979 Fed. Rep. of Germany ..... 432/122
2517814 6/1983 France ..... 432/122

*Primary Examiner*—John J. Camby
*Attorney, Agent, or Firm*—Weingarten, Schurgin, Gagnebin & Hayes

[57] ABSTRACT

A multi-zone furnace having one or more walking beam conveyors operative in association with movable isolation doors to provide selective isolation of furnace zones and efficient transport and processing of a product through successive furnace zones.

6 Claims, 9 Drawing Figures

MULTI-ZONE FURNACE SYSTEM

FIELD OF THE INVENTION

This invention relates to furnaces, and more particularly, to high temperature precision furnaces for the heat processing of products.

BACKGROUND OF THE INVENTION

Furnaces for the heat processing of products can include one or more heat zones along the length of the furnace, with respective entrance and exit zones at the furnace ends, and one or more intermediate zones between heat zones. The zones can be separated by movable doors, which can be raised to provide for product conveyance between adjacent zones, and which can be closed to isolate the adjacent zones from each other. Different atmospheres and/or temperatures may be provided in respective zones in accordance with particular processes being performed on product transported through the furnace. It is often necessary or desirable that respective zones of the furnace be isolated from adjacent zones in order to accomplish particular processing operations. It is also desirable that the furnace be capable of performing a variety of different processes or process sequences without alteration of the furnace hardware. Furnaces are known in which adjacent zones can be selectively isolated, and these furnaces have employed a walking beam conveyor in the heat zone to convey a product through the heat zone, and a roller or other type of separate conveyor within the adjacent zone which is operative to convey a product in the adjacent zone.

SUMMARY OF THE INVENTION

In accordance with the present invention, a multi-zone furnace is provided for the efficient transport and processing of a product through successive zones of the furnace, and which zones can be selectively isolated one from the other to suit particular processes being performed. The invention employs a walking beam or movable hearth conveyor as the sole conveying mechanism for the furnace. In a preferred embodiment, the furnace comprises a plurality of walking beam conveyors longitudinally arranged for sequential transport of the product through the successive furnace zones. Each walking beam is of a length to encompass the heat zone in which it is disposed and adjacent zones for conveyance of the product therebetween. Movable doors are provided to selectively isolate each zone and are operative in association with the walking beam conveyors to allow transport between zones in accordance with an intended processing sequence.

DESCRIPTION OF THE DRAWINGS

The invention will be more fully understood from the following detailed description taken in conjunction with the accompanying drawings in which.

DETAILED DESCRIPTION OF THE INVENTION

Figure 1:
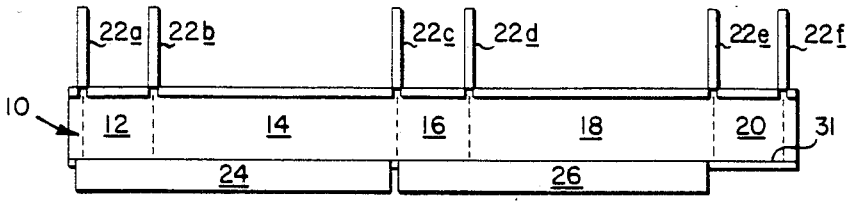
FIG. 1 is a diagrammatic representation of a multi-zone furnace in accordance with the invention.

Referring to FIG. 1, there is shown in diagrammatic form a furnace which includes a furnace chamber 10 having an entrance zone 12, a first heat zone 14, an intermediate zone 16, a second heat zone 18 and an exit zone 20 disposed in sequence along the furnace chamber. A plurality of movable doors 22 are operative to selectively isolate each of the zones, these doors being shown in the open position. A door **22*a* is provided at the entrance end of the entrance zone 12, and a door 22*b* separates the entrance zone 12 and the first heat zone 14. The intermediate zone 16 includes entrance and exit doors 22*c* and 22*d*, while the exit zone 20 includes entrance and exit doors 22*e* and 22*f*. Each of the doors is slidable to an open position, and a closed sealing position. First and second walking beam conveyors 24 and 26 are disposed within the hearth 31 of the furnace chamber. The entrance zone 12, intermediate zone 16 and exit zone 20 are each of the same length, and the first and second heat zones 14 and 18 are each of the same length. The walking beam 24 and walking beam 26 are of the same length, which encompasses the respective heat zone and an adjacent zone. Thus, walking beam 24 is of a length substantially equal to the length of the first heat zone and the length of the entrance zone or intermediate zone. The walking beam 26** is of a length substantially equal to that of the second heat zone and the length of the intermediate zone or exit zone.

Figure 3:
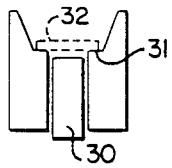
FIG. 3 is an end elevation view of a walking beam conveyor in its lowered position.
Figure 2:
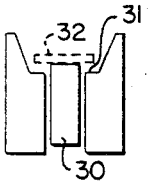
FIG. 2 is an end elevation view of a walking beam conveyor in its raised or elevated position.

Each walking beam is operative in a cyclic manner to move a product in stepwise fashion through the respective zones of the furnace chamber. The operation of walking beam conveyors is itself known, an exemplary walking beam being shown in U.S. Pat. No. 3,633,885, assigned to the assignee of this invention. Beam operation is illustrated in FIGS. 2 and 3. The beam 30 is raised above the hearth surface 31 with a product 32 thereon (FIG. 2), and in this raised position is advanced by a predetermined amount, and is then lowered to a position below the hearth surface 31 (FIG. 3) to deposit the product 32 onto the hearth surface. In the lower position, the walking beam is retracted to an initial position and is again raised above the hearth surface to commence another conveying cycle. When the beam lowers and retracts, the product remains supported on the hearth as shown in FIG. 3. When the beam is raised and advances, the product is supported on the upper surface of the beam and is conveyed forward with the beam.

The cooperative action of the walking beam conveyors and the movable door permits each of the zones to be selectively isolated from adjacent zones. The particular operation of the respective conveyors and doors can be determined to accomplish a given processing sequence. The system is especially efficient in that the walking beam conveyors are part of the furnace hearth and remain within the heated environment of the furnace, and do not detract from the stable thermal environment of the furnace.

Figure 4:
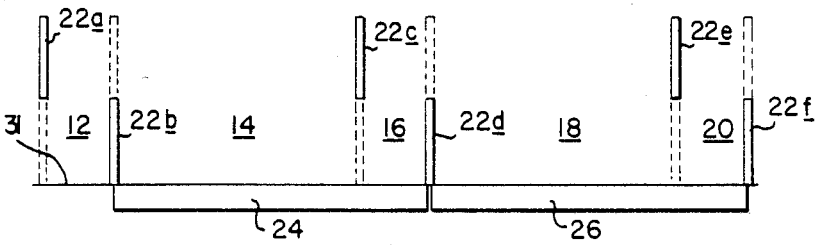
FIGS. 4–7 are diagrammatic representations of a multi-zone furnace in accordance with the invention, and illustrating typical operational positions of the walking beam conveyors and movable doors during a processing sequence.
Figure 5:
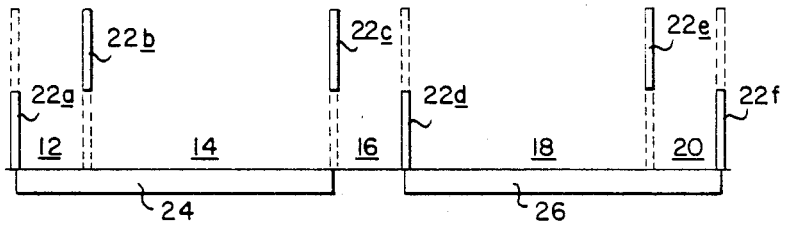
Figure 6:
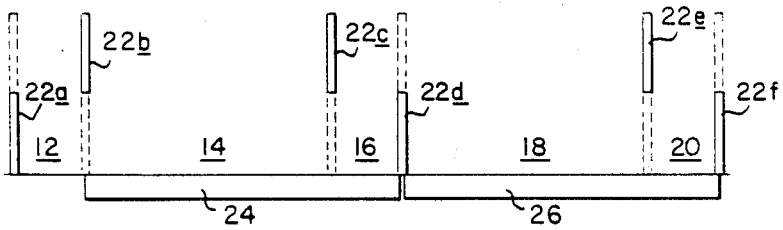
Figure 7:
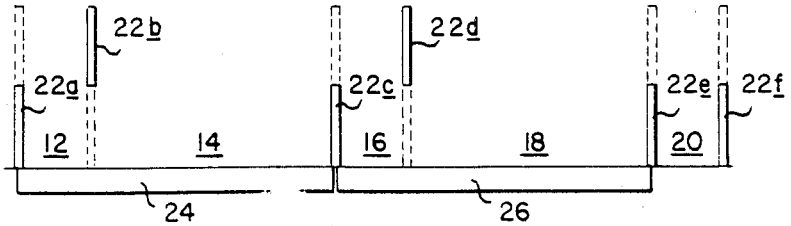

In the illustrated embodiment, the beam 24 has an initial position, as shown in FIG. 4, with door 22*a* raised to permit a product to be introduced onto the hearth 31 of the entrance zone 12. The door 22*b* is closed to retain the heated environment of the heat zone 14. The exit door 22*f* is also closed to retain the heated environment of the heat zone 18. The door 22*a* is then closed, as shown in dotted outline in FIG. 4, and as shown in FIG. 5, the door 22*b* is raised and the beam 24 is retracted to the position shown in FIG. 5 to initiate a product transport cycle. The beam 24 is next advanced to the position shown in FIG. 6, and conveys a product from the zone 12 into zone 14. During forward motion of beam 24, product within zone 14 is also moved forward in stepwise fashion within this zone, and product at the exit end of the heat zone 14 is moved into intermediate zone 16. The beam 24 again retracts to the position shown in FIG. 7, door 22*c* is closed, and door 22*d* is opened to permit beam 26 to retract to the position illustrated in FIG. 7. The door 22*e* is closed after the beam 26 retracts. After door 22*e* is raised, the beam 26 is advanced to move product from the zone 16 into heat zone 18 and thence from heat zone 18 into exit zone 20.

The doors 22*a*–22*f* can be raised and lowered by any suitable mechanism, and in the closed position provide a seal between the respective zones to isolate the atmosphere of one zone from the other, since in many instances the respective furnace zones may contain different gaseous atmospheres. The respective furnace zones may also be of different temperatures. Thus, an intended temperature profile is provided along the length of the furnace, and an intended sequence of atmospheres for an intended processing sequence for the particular product.

The zones 12, 16 and 20, can be selectively isolated depending upon the relative positions of the beams 24 and 26, to provide adjacent zones which are thermally and atmospherically separated from the adjacent heat zones. The particular sequence of door openings and closures in relation to conveyor movement are determined in accordance with a particular processing sequence to be accomplished. All conveyance of product through the several zones of the furnace is accomplished by the walking beam conveyors operating in their cooperative cyclic manner.

In an alternative implementation, multiple beams can be provided along each longitudinal section of the furnace, each array of multiple beams operating in unison, such as shown in U.S. Pat. No. 4,116,619, and assigned to the assignee of this invention.

Figure 8:
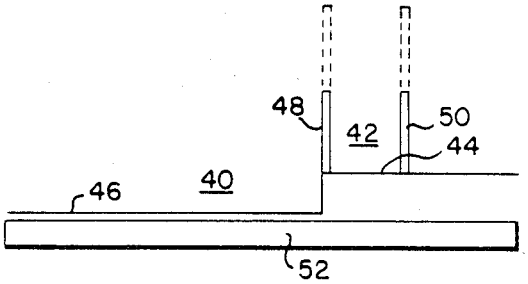
FIG. 8 is a diagrammatic representation of an alternative embodiment of the invention in which a walking beam conveyor operates in two modes, each at a respective height.
Figure 9:
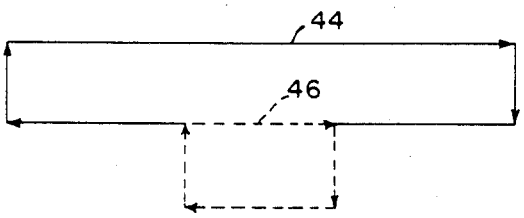
FIG. 9 is a schematic diagram illustrative of the motion of the walking beam conveyor of FIG. 8.

An alternative embodiment is illustrated in FIGS. 8 and 9, in which the furnace is shown as having a single heat zone 40 and a single adjacent zone 42, with the adjacent zone existing at a higher hearthline 44 than the hearthline 46 of the heat zone. A door 48 is provided between the heat zone and the adjacent zone, and a door 50 is provided at the exit end of the adjacent zone. A walking beam 52 is disposed within the furnace hearth and is operative at the lower hearthline 46 of the heat zone to stepwise convey a product along the length of the heat zone in relatively short increments, as shown in dotted line form in FIG. 9. After propulsion of the product through the heat zone, the beam operates at a higher level of the hearthline 44 of the adjacent zone 43 and with a longer cyclic stroke, illustrated in solid line in FIG. 9, to transport the product from the heat zone into the adjacent zone.

It will be appreciated that the invention can be embodied in a furnace of one or more heat zones and one or more adjacent zones in accordance with particular heat processes to be accomplished, and in a variety of furnace structures suitable to an intended purpose. The invention is not to be limited by what has been particularly shown and described except as indicated in the appended claims.

What is claimed is:

1. A multi-zone furnace comprising:

a furnace chamber having a plurality of heat zones and an intermediate zone between heat zones, said zones being contiguously disposed along the length of the furnace chamber;

a plurality of walking beam conveyors each disposed in the hearth of the furnace chamber and each associated with a respective heat zone;

each of the walking beams having a length substantially equal to the combined length of the associated heat zone and intermediate zone;

a plurality of doors each disposed at the juncture between a heat zone and intermediate zone and movable between an open position to permit transport of a product between respective zones, and a closed position to provide isolation between respective zones;

said walking beam conveyors and said doors being cooperative in sequence to transport a product between zones and provide selective isolation of one or more of said zones.

2. The furnace of claim 1 including an entrance zone adjacent to a heat zone and having a length substantially equal to the length of the intermediate zone adjacent to this heat zone;

the walking beam associated with this heat zone being operative in one mode to convey a product between the entrance zone and heat zone, and in a second mode to convey a product between the heat zone and intermediate zone.

3. The furnace of claim 2 including an entrance door at the entrance of the entrance zone, and an exit door between the entrance and heat zones, these doors being movable between open and closed positions in cooperation with the associated walking beam to provide selective isolation of the entrance zone.

4. A multi-zone furnace comprising:

a furnace chamber having a plurality of heat zones, an intermediate zone between heat zones, an entrance zone at the entrance to the first heat zone, and an exit zone at the exit of the last heat zone, said zones being contiguously disposed along the length of the furnace chamber;

a plurality of walking beam conveyors each disposed in the hearth of the furnace chamber and each associated with a respective heat zone;

each of the walking beams having a length substantially equal to the combined length of the associated heat zone and an adjacent zone;

an entrance door at the entrance to the entrance zone, an exit door at the exit of said exit zone, and a plurality of doors each disposed at the juncture between a heat zone and adjacent zone, each door movable between an open position to permit transport of a product, and a closed position to provide isolation between respective zones;

the walking beam associated with each heat zone being operative in one mode to convey a product between one adjacent zone and heat zone, and in a second mode to convey a product between the heat zone and another adjacent zone;

said walking beam conveyors and said doors being cooperative in sequence to transport a product between zones and provide selective isolation of one or more of said zones.

5. A multi-zone furnace comprising:

a furnace chamber having at least one heat zone and at least one zone adjacent to the heat zone and disposed along the length of the furnace chamber;

a door separating the heat zone from the adjacent zone and movable between an open position to permit transport of product between the respective zones, and a closed position to provide isolation between the respective zones;

a door disposed at the opposite end of the adjacent zone from the first door and movable between an open and a closed position;

a walking beam conveyor disposed in the hearth of the furnace chamber and having a length substantially equal to the combined length of the heat zone and the adjacent zone and operative to cyclically convey a product through the heat zone and adjacent zone;

said walking beam conveyor and said doors being cooperative in sequence to transport a product between the zones and provide selective isolation of respective zones.

6. A multi-zone furnace comprising:

a furnace chamber having at least one heat zone and at least one zone adjacent to the heat zone and disposed along the length of the furnace chamber;

the heat zone having a hearth at a level different from the hearth level of the adjacent zone;

a walking beam conveyor disposed in the furnace chamber and operative in a short stroke mode to convey a product along the hearth of the heat zone, and in a long stroke mode to convey a product from the heat zone to the adjacent zone.

* * * * *